US006893343B2

(12) United States Patent
Suda et al.

(10) Patent No.: US 6,893,343 B2
(45) Date of Patent: May 17, 2005

(54) GAMING MACHINE AND METHOD OF CONTROLLING THE SAME

(75) Inventors: Satoshi Suda, Tokyo (JP); Koji Kazaoka, Tokyo (JP); Takayuki Suzuki, Tokyo (JP)

(73) Assignee: Konami Corporation, Tokyo (JP)

( * ) Notice: Subject to any disclaimer, the term of this patent is extended or adjusted under 35 U.S.C. 154(b) by 17 days.

(21) Appl. No.: 10/401,543

(22) Filed: Mar. 31, 2003

(65) Prior Publication Data

US 2003/0232645 A1 Dec. 18, 2003

(30) Foreign Application Priority Data

Jun. 14, 2002 (JP) ..... P2002-173826

(51) Int. Cl.[7] ..... G07F 17/34

(52) U.S. Cl. ..... 463/20; 463/16; 463/22; 463/35; 273/143 R; 273/138.2

(58) Field of Search ..... 463/20, 16, 22, 463/35; 273/143 R, 138.2

(56) References Cited

U.S. PATENT DOCUMENTS 5,695,188 A * 12/1997 Ishibashi ..... 273/143 R
6,416,411 B1 * 7/2002 Tsukahara ..... 463/35
2002/0018074 A1 * 2/2002 Buil et al. ..... 345/719

FOREIGN PATENT DOCUMENTS

JP 8-173592 7/1996

* cited by examiner

*Primary Examiner*—Benjamin Layno
(74) *Attorney, Agent, or Firm*—Sughrue Mion, PLLC

(57) ABSTRACT

A random number selector selects a random number. A symbol selector selects a symbol associated with the random number. A symbol display displays the symbol. A sound data selector selects at least one of a plurality of sound data based on the random number. A sound reproducer reproduces the at least one sound data as an audible sound, at a predetermined timing while the symbol is displayed.

11 Claims, 7 Drawing Sheets

FIG. 1

| STOP POSITION | REEL 1 SYMBOL | REEL 1 SOUND | REEL 2 SYMBOL | REEL 2 SOUND | REEL 3 SYMBOL | REEL 3 SOUND | REEL 4 SYMBOL | REEL 4 SOUND | REEL 5 SYMBOL | REEL 5 SOUND |
|---|---|---|---|---|---|---|---|---|---|---|
| 0 | Bo | A | S1 | A | Sc | A | S1 | A | Wd | A |
| 1 | Pf | B | Pd | B | Pi | B | Pd | B | Ph | B |
| 2 | Pi | C | Pg | C | Pf | C | Ph | C | Pf | C |
| 3 | Pe | D | Pe | D | S2 | D | S1 | D | Pd | D |
| 4 | Pf | A | S2 | E | Pg | E | Pe | E | Pi | A |
| 5 | Ph | B | Pf | F | Pc | F | Pi | F | Ph | B |
| 6 | S1 | C | Wd | G | Ph | G | S2 | G | Pe | C |
| 7 | Pg | D | Ph | H | Pi | H | Pg | H | Pf | D |
| 8 | Pi | A | S1 | A | Wd | A | Pc | A | Pc | A |
| 9 | Pc | B | Pd | B | Pf | B | Pf | B | Ph | B |
| 10 | Pf | C | Pg | C | Ph | C | Ph | C | S2 | C |
| ..... | ..... | ..... | ..... | ..... | ..... | ..... | ..... | ..... | ..... | ..... |
| | Ph | B | Pg | F | Ph | F | Pg | F | R | B |

FIG. 2

| REEL 1 | | |
|---|---|---|
| STOP POSITION | SYMBOL | SOUND |
| 3 | Pe | D |

| REEL 2 | | |
|---|---|---|
| STOP POSITION | SYMBOL | SOUND |
| 6 | Wd | G |

| REEL 3 | | |
|---|---|---|
| STOP POSITION | SYMBOL | SOUND |
| 0 | Sc | A |

| REEL 4 | | |
|---|---|---|
| STOP POSITION | SYMBOL | SOUND |
| 8 | Pc | A |

| REEL 5 | | |
|---|---|---|
| STOP POSITION | SYMBOL | SOUND |
| 10 | S2 | C |

GAMING MACHINE AND METHOD OF CONTROLLING THE SAME

BACKGROUND OF THE INVENTION

The invention relates to a gaming machine which reproduces sound data as an audible sound in synchronism with display of symbols, as well as to a method of controlling the same.

For instance, Japanese Patent Publication No. 8-173592A discloses a related-art gaming machine which moves columns of symbols so as to run across a pay line. When the columns of symbols are stopped, a different sound is generated for each of the symbols which have come to a halt at the pay line. The gaming machine is constructed such that, according to the kind of a symbol, a sound to be generated when a column of symbols comes to a halt differs in terms of at least one sound element; that is, at least one of tone quality, musical interval, the length of a musical note, and an octave. On the basis of symbols which have come to a halt at the pay line, a determination is made as to whether or not a win has arisen. If the result of determination shows occurrence of a failure, a sound associated with a symbol from among the symbols stopped at the pay line, the symbol having the potential of offering a large payout to a player, is generated.

However, the related-art gaming machine associates a sound to be generated at the time of stoppage of a column of symbols with the symbols themselves. In many cases, a plurality of symbols having the same appearance are provided in a column of symbols provided on a reel. The related-art gaming machine produces the same sound for the symbols having the same appearance. Accordingly, generated sounds tend to become monotonous. In order to enhance the effect of sound presentations, sound rich in variety must be produced.

SUMMARY OF THE INVENTION

It is therefore an object of the invention to provide a gaming machine capable of providing sound presentation which attracts and sustains a player's interest, as well as a method of controlling such a gaming machine.

In order to achieve the above object, according to the invention, there is provided a gaming machine, comprising:

a random number selector, which selects a random number;

a symbol selector, which selects a symbol associated with the random number;

a symbol display, which displays the symbol;

a sound data selector, which selects at least one of a plurality of sound data based on the random number; and a sound reproducer, which reproduces the at least one sound data as an audible sound, at a predetermined timing while the symbol is displayed.

In such a configuration, different sounds may be reproduced for the same symbols, whilst the same sound may be reproduced for different symbols. Consequently, sound rich in variety can be selected regardless of occurrence/failure of a win and appearance of a symbol. Since selected sound data are reproduced as an audible sound in the display operation of the symbol, the player's attention to a displayed symbol can be aroused, thereby attracting the player's interest. Thereby, the effect of sound presentation can be enhanced.

According to the invention, there is also provided a gaming machine, comprising:

a random number selector, which selects a first random number and a second random number;

a symbol selector, which selects a symbol associated with the first random number;

a symbol display, which displays the symbol;

a sound data selector, which selects at least one of a plurality of sound data based on the second random number; and a sound reproducer, which reproduces the at least one sound data as an audible sound, at a predetermined timing while the symbol is displayed.

In such a configuration, sound data are selected with complete independence from a symbol. Consequently, different sounds may be reproduced for the same symbols, whilst the same sound may be reproduced for different symbols. Sound rich in variety can be selected regardless of occurrence/failure of a win and appearance of a symbol. Since the selected sound data are reproduced as an audible sound in the display operation of the symbol, the player's attention to a displayed symbol can be aroused, thereby attracting the player's interest. Thereby, the effect of sound presentation can be enhanced.

Preferably, the predetermined timing is a timing at which the symbol is statically displayed.

In such a configuration, the sound data are reproduced in synchronism with timings at which variably-displayed symbols are statically displayed. As a result, the player's expectation for the symbols to be statically displayed is enhanced, and the player's attention to the displayed symbol can also be aroused. Thus, the player's keen interest can be attracted to games.

Preferably, the plurality of sound data comprises data corresponding to musical tones constituting broken chords.

In such a configuration, sound pleasant for the player can be reproduced. As a result, the player can enjoy playing games more comfortably.

Preferably, the plurality of sound data comprises data corresponding a rest, a monotone, a set of monotones.

In such a configuration, there may be reproduced expression of a musical interval, rhythm, and harmony; for example, expression of a triplet, a quadruplet, a tie (slur) of two notes, and a phrase consisting of a plurality of notes. As a result, sound presentation rich in variety can be provided, and hence the player's interest can be attracted.

Preferably, the plurality of sound data comprises data corresponding sound effects.

Here, the sound effects correspond to all sounds which are not included in a musical tone; for example, a human voice, natural sounds such as the sound of a wave and the sound of the wind, and the cry of the animal. Use of the sound effect data provides the player with an unexpected surprise at the time of display of the symbols. Further, this arouses the player's curiosity about the next sound to be reproduced. As a result, the player's interest can be attracted.

Preferably, the sound data selector changes the sound data to be selected in a case where a predetermined condition is satisfied.

Here, the predetermined condition include lapse of a predetermined time, a change in the weather, the situation of a game, a change in the amount of credit, the number of tokens to be paid, and information which is made available by the player (e.g., via a player card) when a token is inserted; e.g., a gender, an age, and an achievement in the past. Sound data are changed on the basis of these conditions. As a result, sound to be reproduced is changed, thereby changing an impression imparted to the player. Sound presentation which makes the player less likely to feel boredom can be provided.

According to the invention, there is also provided a method of controlling a gaming machine, comprising steps of:

selecting a random number;

selecting a symbol associated with the selected random number;

displaying the selected symbol;

selecting at least one of a plurality of sound data based on the selected random number; and reproducing the selected at least one sound data as an audible sound, at a predetermined timing while the symbol is displayed.

According to the invention, there is also provided a method of controlling a gaming machine, comprising steps of:

selecting a first random number;

selecting a second random number;

selecting a symbol associated with the selected first random number;

displaying the selected symbol;

selecting at least one of a plurality of sound data based on the selected second random number; and reproducing the selected at least one sound data as an audible sound, at a predetermined timing while the symbol is displayed.

Preferably, the predetermined timing is a timing at which the symbol is statically displayed.

Preferably, the method further comprises a step of changing the sound data to be selected in a case where a predetermined condition is satisfied.

BRIEF DESCRIPTION OF THE DRAWINGS

The above objects and advantages of the present invention will become more apparent by describing in detail preferred exemplary embodiments thereof with reference to the accompanying drawings, wherein:

FIG. 1 is a view showing a relationship between stop positions, symbols, and stop sounds of a gaming machine according to an embodiment of the invention;

FIG. 2 is a view showing a relationship between stop positions, symbols, and stop sounds of a gaming machine according to the embodiment;

DETAILED DESCRIPTION OF THE PREFERRED EMBODIMENTS

Figure 3:
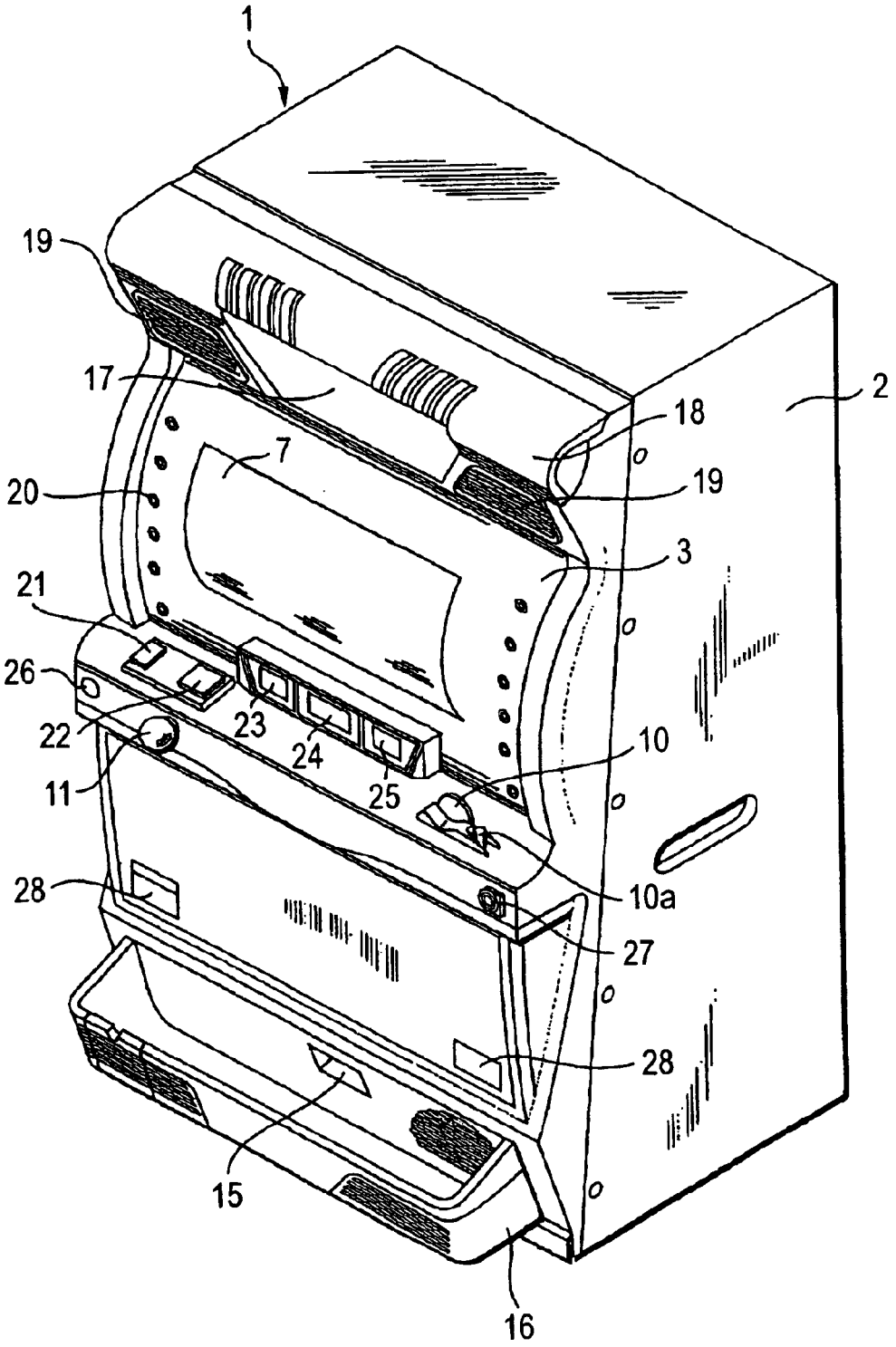
FIG. 3 is a perspective view showing the external appearance of the gaming machine of the embodiment.

A gaming machine according to one embodiment of the invention will be described hereinbelow. The gaming machine of this embodiment selects a random number to determine a displayed symbol out of plural kinds of symbols, and also selects one sound data out of plural kinds of sound data associated with the selected random number. In short, sound data are selected with complete independence from the appearance of a symbol or occurrence/failure of a win. The thus-selected sound data are reproduced as an audible sound in synchronism with display of symbols. For example, stop positions shown in FIG. 1 can be determined by random numbers which have been extracted through the internal random number selection to display symbols. The stop positions correspond to respective symbols provided on reels 1 through 5. For example, in the case of the reel 1, symbol Bo is associated with stop position 0; symbol Pf is associated with stop position 1; symbol Pi is associated with stop position 2. Under the assumption that three symbols can be statically displayed at an upper position, a middle position, and a lower position on each reel display, when stop position 1 is selected for the reel 1 by a random number extracted through the internal random number selection, the symbol Pf is statically displayed at the middle position on the reel 1. If stop position 3 is selected for the reel 1 by a random number extracted through the internal random number selection, a symbol Pe is statically displayed at the middle position on the reel 1.

In the embodiment, a sound data set associated with the stop position determined by the random number is selected from the plurality of sound data sets. FIG. 1 illustrates a state in which sound data associated with the stop positions have already been selected. For example, stop position 0 of the reel 1 is associated with sound data A stop position 1 of the reel 1 is associated with sound data B. Similarly, even in the case of the reels 2 through 5, sound data associated with stop positions have been selected. For example, stop positions of the reels 1 through 5 have been determined as "3, 6, 0, 8, and 10" by random numbers extracted through the internal random number selection. Symbols associated with the stop positions are "Pe, Wd, Sc, Pc, and S2." The sound data sets associated with the stop positions are therefore determined as "D, G, A, A, and C." These can be summarized in the table shown in FIG. 2. stop positions for the respective reels are determined by the random numbers extracted through the internal random number selection. Symbols associated with the stop positions are statically displayed. Concurrently, sound data associated with the stop positions are selected on a per-reel basis and reproduced in synchronism with display of the symbols.

In this way, a sound data set associated with a numeral determined on the basis of the random number to be used for displaying a symbol is selected from the plurality of sound data sets. Hence, different sounds can be produced even for the same symbols. In contrast, the same sound can be produced for different symbols. As a result, sound rich in variety can be selected irrespective of the occurrence/failure of a win or the appearance of a symbol.

The invention can be applied to any apparatus capable of displaying symbols (i.e., an apparatus which provides a game). Here, the invention is explained by taking, as an example, a gaming machine which can variably display a plurality of kinds of symbols in the direction of a column (or in the direction of a row) and can statically display variably-displayed symbols on the basis of the result of internal random number selection. Mechanical rotary drums (or reels) may be used for parts which variably display symbols, or video reels which variably display symbols as images on liquid-crystal screens or the like may be used. Alternatively, the invention can be applied to a gaming machine such as a slot machine in which reels are sequentially stopped irrespective of the player's will, as well as to a skilled-stop gaming machine which enables a player to determine a timing and sequence at which respective drums (or reels) are to stop by actuation of stop buttons. In the embodiment, a token is adopted as a gaming value. However, any other medium may be adopted as the gaming value.

As shown in FIG. 3, the gaming machine 1 comprises a housing 2 and a front panel 3 reclosably attached to the front of the housing 2. Disposed behind the front panel 3 is a symbol display 7 which is constituted of a liquid-crystal panel or CRT (Cathode Ray Tube) and displays symbols in, e.g., five columns (each aligned in the vertical direction of the gaming machine). The embodiment adopts a video reel system. As a result of a program being executed, five reels are displayed on the symbol display 7. As shown in FIG. 1, the symbol display 7 has five reels for variably and statically displaying symbols in the direction of the columns (i.e., the vertical direction of the gaming machine); specifically, reels 1 through 5. Each of the reels can variably or statically display various symbols.

According to a reel system including the video reel system, enhancement of the player's expectation for a symbol to be statically displayed and attraction of the player's attention to a symbol displayed can be effected by regenerating sound data in synchronism with a timing at which variably-displayed symbols are statically displayed. As a result, the player's keen interest can be attracted to games.

A token insertion slot 10 and a token return button 10*a* to be used for returning tokens when inserted coins have caused clogging are provided on the front of the housing 2. A start lever 11 is a lever for starting rotational display (variable display) of the symbol display 7.

The gaming machine 1 starts a game by the player specifying a valid pay line (i.e., a payout line). There player can set a plurality of pay lines, e.g., a horizontal center line, horizontal upper and lower lines, and sloped lines. BET operation is performed by insertion of a token into the token insertion slot 10 to be described later or by betting some of the tokens reserved by a reserved token insert button 21. The BET operation can also be performed by combined use of these BET operations.

When the pay line has been specified through the player's BET operation and the player has actuated the start lever 11, the symbol display 7 variably displays symbols. When a predetermined period of time has lapsed, the symbol display 7 sequentially stops the variably-displayed symbols. The symbols are stopped in sequence from left to right while the player faces the symbol display 7. At the time of stoppage of the symbols, the symbols are stopped at a time interval of, e.g., 0.5 seconds. When a combination of predetermined symbols is displayed along any of the pay lines as a result of the symbols having come to a halt, a win associated with the combination of symbols is provided.

A token payout port 15 and a token receiver 16 are provided at a lower portion of the front panel 3. A game presentation indicator 17 which is driven for providing game presentation is provided at an upper portion of the front panel 3. The game presentation indicator 17 is formed from, e.g., an LCD (liquid-crystal device) or lamps of various types. The embodiment shows an example where an LCD is adopted. A bonus game indicator 18 is provided at an upper portion of the front panel 3. The bonus game indicator 18 is formed from an LED (light-emitting diode). The bonus game indicator 18 displays winning or acquisition of a bonus prize which offers a high gaming value to the player, game presentations, and occurrence of an error. Speakers 19 produce sound guidance, music, sound effects, or the like. When a win has arisen for a bonus prize, a game is developed in a manner advantageous to the player; for example, a game is developed such that the probability of occurrence of a win becomes one-third.

A plurality of lamps 20 provided on the front panel 3 effect display of a game, such as display of a validated pay line or display of occurrence of a win, in accordance with the number of inserted tokens (or the amount of a betted credit) through illumination, extinction, or blinking. The reserved token insert button 21 is for using only a predetermined number of tokens reserved in an unillustrated token storage. A reserved token infusion button 22 is for using a maximum specified number of tokens reserved in the unillustrated token storage. A reserved token count display 23 displays the number of tokens stored in the unillustrated token storage. A win count display 24 displays the number of times a win has arisen or the number of remaining games at the time of occurrence of a win for a bonus prize. A payout token count display 25 displays the number of tokens to be paid. The reserved token count display 23, the win count display 24, and the payout token count display 25 are each formed from, e.g., an LED. A settlement button 26 effects settlement of reserved tokens. A locking device 27 locks a door when turned in a proper direction. The type and manufacturer of the gaming machine 1 are provided on a label 28.

Figure 4:
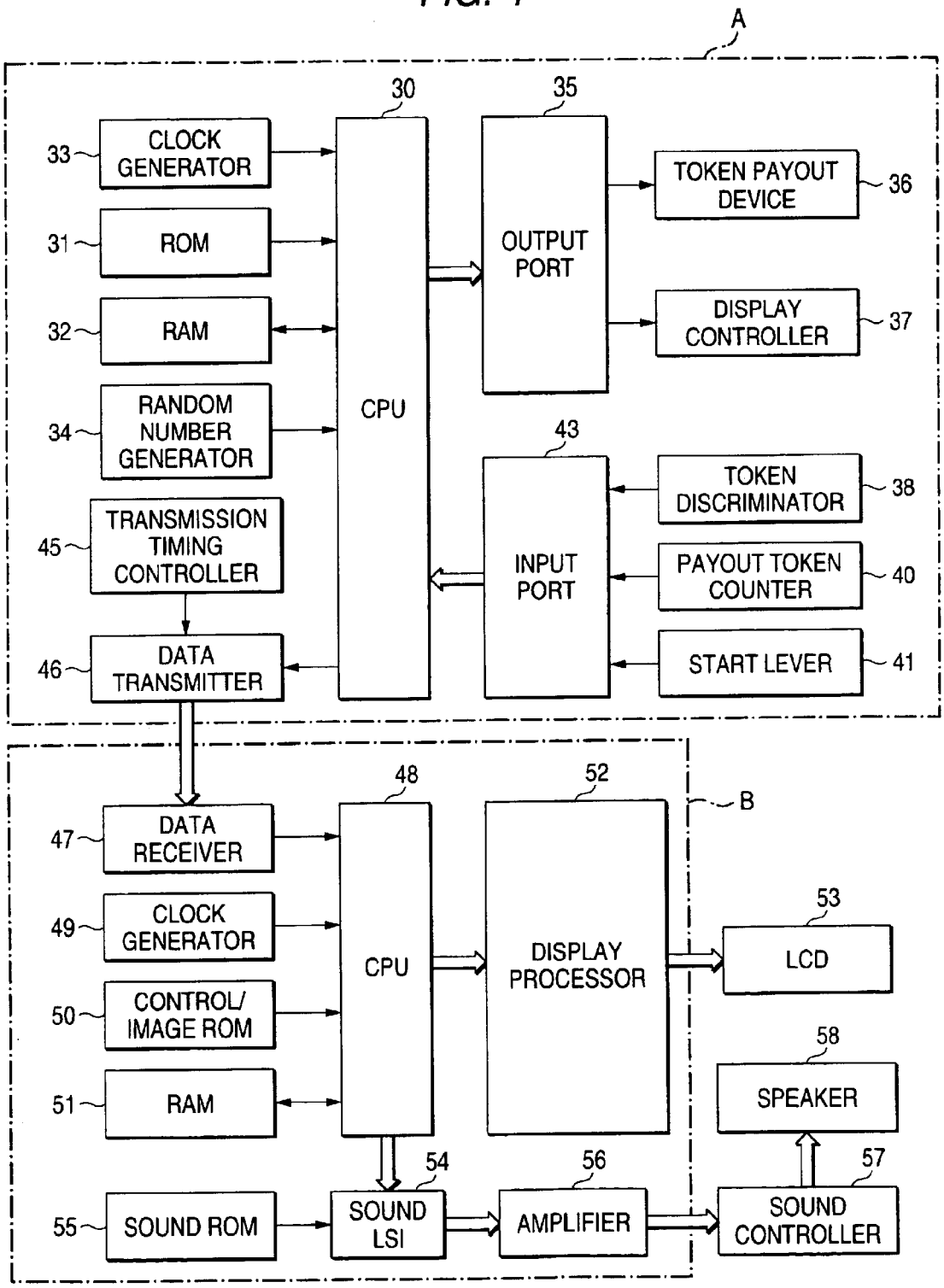
FIG. 4 is a block diagram showing an electrical configuration of the gaming machine of the embodiment.

FIG. 4 is a block diagram showing an electrical configuration of the gaming machine 1 of the embodiment. As shown in FIG. 4, the gaming machine 1 is electrically made up of a main board A and a sub-board B. The main board A has a CPU 30, ROM 31, and RAM 32 and performs control operation in accordance with a preset program. In addition to storing a control program to be used for controlling operation of the gaming machine 1, the ROM 31 stores a prize group sampling table to be used for determining a prize group in advance (through internal lottery). The CPU 30, the ROM 31, and the RAM 32 constitute a symbol selector.

The CPU 33 is connected to a clock generator 33 for generating a reference clock pulse and to a random number generator 34 for generating a given random number. The CPU 30 and the random number generator 34 constitute a random number selector. By way of an output port 35, a control signal sent from the CPU 30 is output to a token payout device 36, which pays tokens, and to a symbol display controller 37, which controls the symbol display 7.

A signal output from a token discriminator 38 for determining whether or not a token is genuine; a signal output from a payout token counter 40 for counting the number of tokens to be paid; and a signal output from a start lever 41 which starts spinning of reels are input to the CPU 30 by way of an input port 43. The signal output from the CPU 30 is output to the sub-board B by way of a data transmitter 46 under control of a transmission timing controller 45 for controlling a timing at which a signal is to be transmitted to the sub-board B.

In the sub-board B, the signal output from the data transmitter 46 is input to a data receiver 47. The signal input to the data receiver 47 is processed by a CPU 48. The CPU 48 is connected to a clock generator 49 for generating a reference clock pulse, ROM 50 having various programs and image data recorded therein, and RAM 51. Data pertaining to images are output from the CPU 48 to a liquid-crystal display 53 via a display processor 52, which performs image processing operation. The liquid-crystal display 53 displays characters, a still image, a moving image, and the like.

Data pertaining to sound are output from the CPU 48 to an amplifier 56 via a sound LSI 54, which performs sound processing operation. The sound LSI 54 extracts required sound data from sound ROM 55, thereby processing sound data. Sound data which have been subjected to processing, such as amplification, performed by the amplifier 56 are output to a speaker 58 via a sound controller 57. The CPU 48, the ROM 50, and the RAM 51 constitute a sound data selector. The sound LSI 54, the amplifier 56, the sound controller 57, and the speaker 58 constitute a sound reproducer.

The sound data employed in the embodiment are stored in the ROM 50, the RAM 51, and the sound ROM 55. The sound data are musical tone data. In relation to the musical tone data, audible sounds reproduced by the sound reproducer made up of the sound LSI 54, the amplifier 56, the sound controller 57, and the speaker 58 mutually constitute broken chords. Since the musical tone data constituting broken chords are used, sound pleasant for the player can be reproduced. The musical tone data may be formed from rest, monotone, or a plurality of sounds. By the musical tone data, a musical interval, rhythm, and harmony can be expressed; for example, a triplet, a quadruplet, a tie (slur) of two notes, and a phrase consisting of a plurality of notes can be expressed.

Here, the sound data may be sound effect data which are reproduced by the sound reproducer, to thereby produce audible sounds. Here, the sound effects correspond to all sounds which are not included in a musical tone; for example, a human voice, natural sounds such as the sound of a wave and the sound of the wind, and the cry of the animal. Use of the sound effect data provides the player unexpected surprise at the time of display of the symbols. Further, this arouses the player's curiosity about the next sound to be reproduced.

Figure 5:
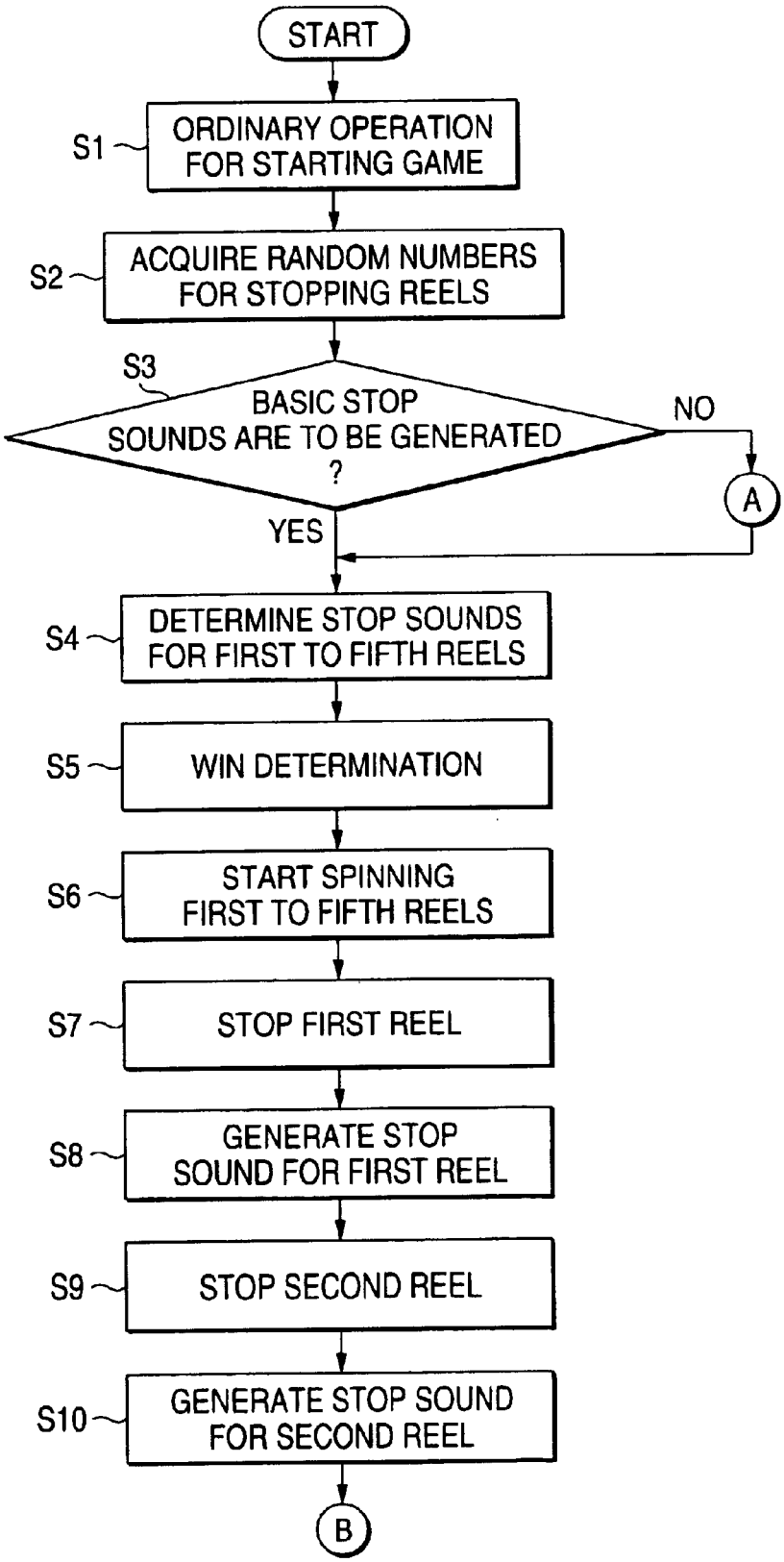
FIG. 5 is a flowchart showing operation of the gaming machine of the embodiment.
Figure 6:
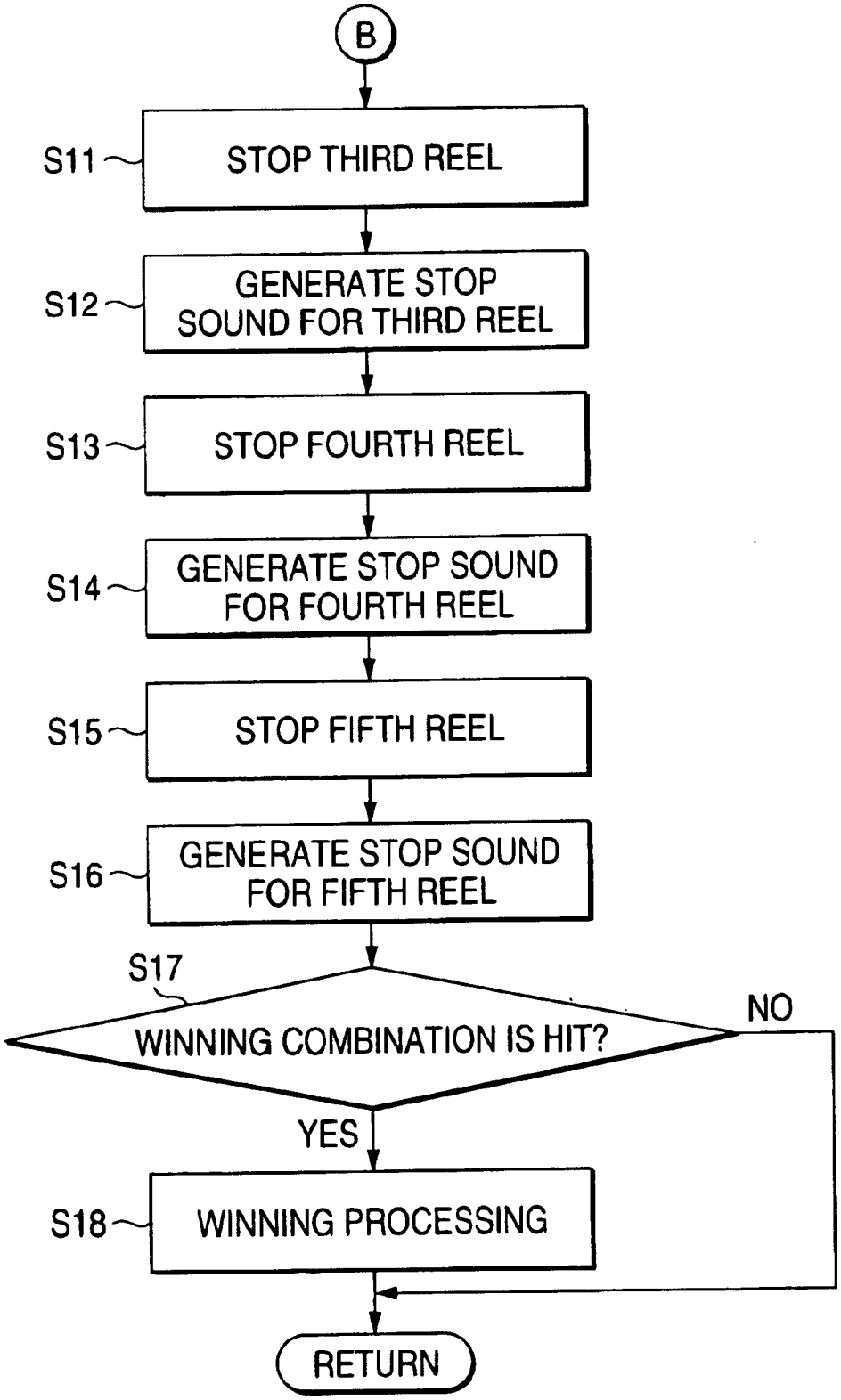
FIG. 6 is a flowchart showing operation of the gaming machine of the embodiment.
Figure 7:
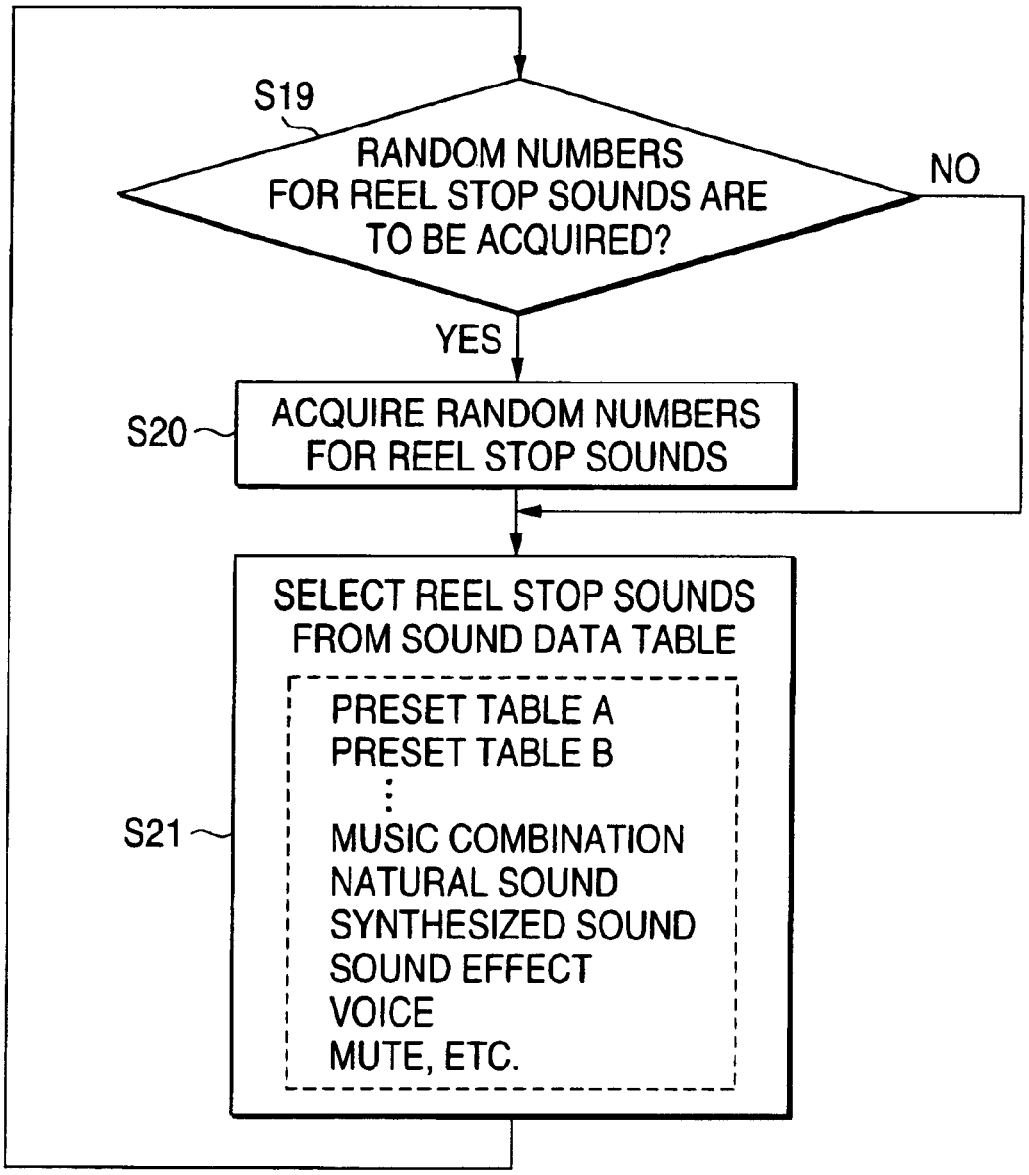
FIG. 7 is a flowchart showing operation of the gaming machine of the embodiment.

Operation of the gaming machine of the embodiment having the foregoing configuration will now be described. FIGS. 5 through 7 are flowcharts showing operation of the gaming machine of the embodiment. First, an ordinary game start operation is performed (step S1). Here, as mentioned above, one or more pay lines are specified by BET operation performed by the player, and the start lever 11 is actuated. Next, random numbers (first random numbers) for determining stop numbers (stop positions) of the respective reel strips are acquired (step S2).

In the embodiment, a sound is generated in synchronism with the timings at which the respective reels come to a halt. Here, a sound generated when the respective reels are stopped is called a stop sound. A determination is made as to whether or not a sound which serves as the basis of the stop sound; that is, a basic stop sound, is to be produced (step S3). In the embodiment, the stop sound is associated with the respective reels in advance. The sound of a harp, or another musical instrument, is used as the basic stop sound. Any sound may be selected for the basic stop sound. Any of the sounds registered in sound data tables, which will be described later, may be used.

When the basic stop sound is not to be produced, processing shifts to step S19 shown in FIG. 7. When the basic stop sound is to be produced, stop sounds for the first to fifth reels are set (step S4). Through setting operation, sound data associated with the stop positions shown in FIG. 1 are set as the basic stop sounds.

A determination is made as to whether or not a win has arisen (step S5). The reels start spinning in ascending order from the first reel to the fifth reel (step S6). In the embodiment, as mentioned above, the reels are stopped in sequence; for example, from left to right of the symbol display 7. At the time of stoppage, the reels come to a halt at time intervals of, e.g., 0.5 seconds.

When the first reel comes to a halt (step S7), the stop sound for the first reel is generated (step S8). Next, when the second reel comes to a halt (step S9), the stop sound for the second reel is generated (step S10). When the third reel is stopped (step S11), the stop sound for the third reel is generated (step S12). When the fourth reel is stopped (step S13), the stop sound for the fourth reel is generated (step S14). Finally, when the fifth reel is stopped (step S15), the stop sound for the fifth reel is generated (step S16). In this way, the reels come to a halt in sequence from the first reel to the fifth reel, and the reel stop sounds for the respective reels are generated until the fifth reel comes to a stop. Accordingly, as mentioned above, when the generated sounds correspond to the musical tone data which constitute broken chords or when the musical tone data are formed from rest, monotone, or a plurality of sounds, a sound pleasant for the player is produced as if a musical instrument is being played. Further, the sound effect data are sequentially produced, thereby imparting surprise to the player or arousing the player's attention.

Next, a determination is made as to whether or not a win has arisen (step S17). If a win has arisen, win processing is performed (step S18), and processing returns to the start. In contrast, if a win is determined not to have arisen in step S17, processing returns to the start.

In step S3, if the basic stop sound is determined not to be produced, a determination is made as to whether or not random numbers for reel stop sound purpose are to be acquired (step S19). If the random numbers are not to be acquired, processing proceeds to step S21. In contrast, if the random numbers are to be acquired, random numbers for reel stop purpose (second random numbers) are acquired (step S20), and processing proceeds to step S21.

In step S21, the stop sounds for the first through fifth reels are selected from the sound data tables. For example, there are provided a preset table A, a preset table B, combinations of music, natural sounds, synthesized sounds, sound effects, human voice, rest, and other types of sound data tables. Any one sound table is selected from these tables, thereby determining stop sounds for the reels. Here, random numbers for selecting sound data independently selected in step S20 may also be employed. Further, the random numbers acquired in step S2 for determining stop numbers for the reel strips my also be used. When selection of the sound data tables is completed, processing returns to step S4, thereby setting stop sounds for the respective reels. Every time the reels come to a halt, the selected sound data are reproduced as an audible sound.

In step S20, the second random numbers differing from the first random numbers to be used for displaying the symbols are acquired. In step S21, sound data associated with numerals determined on the basis of the second random numbers are selected from the plurality of sound data sets. Accordingly, sound data that are completely independent of the symbol are selected. Different sounds may be generated for the same symbols, whilst the same sound may be generated for different symbols. Consequently, sound that is very rich in variety can be selected regardless of occurrence/failure of a win and appearance of a symbol.

Although the selected sound data are reproduced as an audible sound, a change in sound data is also effective for enhancing the presentation effect of sound when predetermined requirements are satisfied. Here, the predetermined requirements include lapse of a predetermined time, a change in the weather, the situation of a game, a change in the amount of credit, the number of tokens to be paid, or information which is made available by the player when a token is inserted; e.g., a gender, an age, and an achievement in the past. Sound data are changed on the basis of these requirements. As a result, sound to be reproduced is changed, thereby changing an impression imparted to the player. Sound presentation which makes the player less likely to feel boredom can be offered.

Further, the player's sound favorite can also be recorded on a player card. By utilization of the player card, the player's preferable sound category is specified, and preferred sounds are randomly selected from the category, thereby generating play sounds unique to the player.

At the time of generation of a sound, an image showing the source of that sound can also be displayed. For instance, when the sound of a harp is generated, an illustration of the harp is displayed at the corner of the symbol display. When the sound of a call of a dog is produced, an animation showing a barking dog may be displayed at the corner of the symbol display. As a result, the player can materialize an image while listening to the thus-generated sound.

The invention can be applied not only to the gaming machine using the foregoing reels, but also to a gaming machine by which the player plays card games, such as poker or black jack, while images of cards are being displayed. For example, the invention can also be applied to a gaming machine which offers a bingo game.

The previously-described characteristic operations of the gaming machine of the invention are performed by causing a computer to execute a control program.

The program is available while being recorded on a recording medium, such as a CD-ROM or a DVD. Further, such a program is also available by receiving a signal transmitted from a computer serving also as a transmitter, via a communication network constituted of a transmission medium, such as a public telephone line, a private telephone line, a cable television line, or a radio communication line. The signal is computer data embodied in the form of a predetermined carrier wave including a program. At the time of transmission, the only requirement is to transmit at least a portion of the program over the transmission medium. Namely, there is no necessity for all the data constituting the program to exist in the transmission medium at a single time. A method for transmitting the program from the computer includes a situation in which data constituting the program are consecutively transmitted and a situation in which the data are transmitted intermittently.

What is claimed is:

1. A gaming machine, comprising:

a display, which displays a plurality of reels, each of which is provided with a plurality of symbols;

a random number selector, which selects a random number for selecting one of a plurality of positions on each of the reels which is to be statically placed at a reference position in the display, each of the positions being associated with one of the symbols; and a sound reproducer, which reproduces sound data as an audible sound, at a predetermined timing while a symbol provided in the selected one of the positions is displayed in the display, the sound data being associated with the random number;

wherein an arrangement pattern of the symbols in one of the reels is different from that in another one of the reels.

2. A gaming machine, comprising:

a display, which displays a plurality of reels, each of which is provided with a plurality of symbols;

a random number selector, which selects a first random number for selecting one of positions on each of the reels which is to be statically placed at a reference position in the display, and a second random number for selecting at least one of a plurality of sound data; and a sound reproducer, which reproduces the at least one sound data as an audible sound, at a predetermined timing while a symbol provided in the selected one of the positions is displayed in the display, the sound reproducer reproduces the at least one sound data for each of the reels.

3. The gaming machine as set forth in claim 1 or 2, wherein the predetermined timing is a timing at which the symbol is statically displayed.

4. The gaming machine as set forth in claim 1 or 2, wherein the plurality of sound data comprises data corresponding to musical tones constituting broken chords.

5. The gaming machine as set forth in claim 1 or 2, wherein the plurality of sound data comprises data corresponding a rest, a monotone, a set of monotones.

6. The gaming machine as set forth in claim 1 or 2, wherein the plurality of sound data comprises data corresponding sound effects.

7. The gaming machine as set forth in claim 1 or 2, wherein the sound data selector changes the sound data to be selected in a case where a predetermined condition is satisfied.

8. A method of controlling a gaming machine, comprising steps of:

providing a display, which displays a plurality of reels, each of which is provided with a plurality of symbols;

selecting a random number for selecting one of a plurality of positions on each of the reels which is to be statically placed at a reference position in the display, each of the positions being associated with one of the symbols; and reproducing sound data as an audible sound, at a predetermined timing while a symbol provided in the selected one of the positions is displayed in the display, the sound data being associated with the random number;

wherein an arrangement pattern of the symbols in one of the reels is different from that in another one of the reels.

9. A method of controlling a gaming machine, comprising steps of:

providing a display, which displays a plurality of reels, each of which is provided with a plurality of symbols;

selecting a first random number for selecting one of a plurality of positions on each of the reels which is to be statically placed at a reference position in the display;

selecting a second random number for selecting at least one of a plurality of sound data; and reproducing the selected at least one sound data as an audible sound, at a predetermined timing while a symbol provided in the selected one of the positions is displayed in the display;

wherein the reproducing step is performed for each of the reels.

10. The method as set forth in claim 8 or 9, wherein the predetermined timing is a timing at which the symbol is statically displayed.

11. The method as set forth in claim 8 or 9, further comprising a step of changing the sound data to be selected in a case where a predetermined condition is satisfied.

* * * * *